US006458004B2

(12) United States Patent
Van Breems

(10) Patent No.: US 6,458,004 B2
(45) Date of Patent: Oct. 1, 2002

(54) ELECTRIC PROPULSION SYSTEMS

(76) Inventor: Martinus Van Breems, 54 Beach Rd., Norwalk, CT (US) 06855

( * ) Notice: Subject to any disclaimer, the term of this patent is extended or adjusted under 35 U.S.C. 154(b) by 0 days.

(21) Appl. No.: 09/783,141

(22) Filed: Feb. 15, 2001

Related U.S. Application Data

(60) Provisional application No. 60/182,631, filed on Feb. 15, 2000.

(51) Int. Cl.[7] ..... B63H 5/125
(52) U.S. Cl. ..... 440/6; 440/54
(58) Field of Search ..... 440/54, 6, 7; 114/151; B63H 5/125

(56) References Cited

U.S. PATENT DOCUMENTS

| | | | | |
|---|---|---|---|---|
| 578,879 A | | 3/1897 | Johannsen | |
| 2,885,990 A | | 5/1959 | Hawthorne | |
| 2,987,027 A | * | 6/1961 | Wanzer | 440/54 |
| 3,587,512 A | | 6/1971 | Patterson | |
| 4,734,066 A | | 3/1988 | Burgess | |

FOREIGN PATENT DOCUMENTS

| | | | |
|---|---|---|---|
| WO | WO99/20524 | * | 4/1999 |

* cited by examiner

*Primary Examiner*—Sherman Basinger

(57) ABSTRACT

An electric propulsion system includes a first tube fixedly secured to a hull of a boat and having an upper end adjacent an opening in a surface of the boat and a lower end adjacent an opening in the hull. A second tube is concentrically disposed in the first tube and is withdrawable from the first tube via the upper end. An electric drive motor is disposed within the second tube and is longitudinally movable therein between upper and lower positions. The drive motor has a rotatable output shaft coupled with a propulsion unit that is longitudinally movable with the drive motor between extended and retracted positions. When the drive motor is in the upper position, the propulsion unit is in a retracted position within the second tube. When the drive motor is in the lower position, the propulsion unit is disposed externally of the hull and the lower end of the first tube. The propulsion unit includes a blade assembly rotatably driven by the drive motor to provide propulsion.

19 Claims, 8 Drawing Sheets

ELECTRIC PROPULSION SYSTEMS

CROSS-REFERENCE TO RELATED PATENT APPLICATIONS

This application claims priority from provisional patent application Ser. No. 60/182,631 filed Feb. 15, 2000, the entire disclosure of which is incorporated herein by reference.

BACKGROUND OF THE INVENTION

1. Field of the Invention:

The present invention relates generally to electric propulsion systems for use in maneuvering boats and, more particularly, to electric propulsion systems having retractable propulsion units.

2. Discussion of the Prior Art:

Electric trolling motors have been widely used on conventional fishing boats such as bass boats. Conventional electric trolling motors have a number of disadvantages, especially when used in applications other than for small fishing boats. Many boats lack a suitable deck or transom mounting area for use with a convention trolling motor. Sailboats and smaller boats often do not have appropriate areas to mount a trolling motor. Bow mounts, the most popular configuration for trolling motors, require expensive mounting brackets and remote controls in order to facilitate use. Typically, the motors are hung off the bow in a highly exposed location. The long, exposed shafts and the mounting brackets for the motors are highly stressed and often break. Conventional trolling motors are usually in the way, and do not present a clean, attractive appearance. Often, sailboats are operated with electric motors, some of which are specifically designed for salt water use. Such motors may remain submerged in salt water and typically last for eight to twelve months before failure. This short life makes it desirable to have a motor which can be removed from the corrosive influences of salt water when not in use.

Previous attempts have been made to mount trolling or bow thruster-type propulsion units through the hull of a boat. Such attempts have required large openings in the hull, which may compromise the boat's structural integrity, and are difficult and expensive to install. Cleaning fouled propulsion units is also difficult with prior arrangements.

SUMMARY OF THE INVENTION

Accordingly, it is a primary object of the present invention to overcome the aforementioned disadvantages of prior electric propulsion systems for boats.

Another object of the present invention is to simplify retraction of a propulsion unit of an electric propulsion system in a boat.

An additional object of the present invention is to facilitate cleaning of a propulsion unit of an electric propulsion system in a boat.

A further object of the present invention is to extend the life of electric propulsion systems for boats.

A still further object of the present invention is to allow an electric drive motor used to drive a propulsion unit in a boat to be removed from the water when not in use.

It is also an object of the present invention to reduce the size of an opening needed in the hull of a boat to mount an electric propulsion system.

The present invention has as another object to permit an extended propulsion unit of an electric propulsion system in a boat to flex upon impacting an object.

Yet a further object of the present invention is to facilitate proper orientation of a propulsion unit of an electric propulsion system in a boat to permit retraction into a support tube.

Additionally, it is an object of the present invention to facilitate steering of a propulsion unit of an electric propulsion system in a boat.

Some of the advantages of present invention are that the drive unit and the propulsion unit for the electric propulsion systems can be removed completely, from inside the boat, as a unitary assembly with no loose parts, the propulsion unit can be completely hidden in a retracted position, operation of the propulsion unit can be controlled from various locations on the boat and in various ways including via a handle, a foot control, an electric control panel, a wireless remote and/or a passenger seat, the reliability and ease of servicing the electric drive motor are enhanced, various propulsion units can be used interchangeably in the electric propulsion systems, various electric propulsion systems, motors can be used interchangeably in the drive the propulsion units can be extended and retracted automatically or manually, the electric propulsion systems can be used on a variety of boat types, and the electric propulsion systems can be used for auxiliary power, as a bow thruster, or for primary propulsion.

These and other objects, advantages and benefits are realized with the present invention as generally characterized in an electric propulsion system comprising a first tube extending between an opening in a hull of a boat and an opening in a surface of the boat spaced from the hull. The openings are in longitudinal alignment, with an upper end of the first tube adjacent the opening in the surface and a lower end of the first tube adjacent the opening in the hull. The first tube is fixedly secured to the hull and remains in place. A second tube is concentrically disposed in the first tube and is longitudinally movable relative to the first tube for withdrawal therefrom via the opening in the surface. A drive motor is disposed in the second tube, which may be a steering tube, and is removable from the first tube as the second tube is removed. The drive motor is longitudinally movable relative to the second tube between upper and lower positions. The drive motor has a rotatable output shaft coupled with a propulsion unit. The propulsion unit is longitudinally movable with the drive motor between retracted and extended positions. When the drive motor is in the upper position, the propulsion unit is in the retracted position wherein the propulsion unit is disposed within the second tube. When the drive motor is in the lower position, the propulsion unit is in the extended position wherein the propulsion unit is disposed externally of the hull and the lower end of the support tube. The propulsion unit includes a blade assembly rotated by the output shaft of the drive motor to provide propulsion. An actuating member within the second tube is coupled with the drive motor and is used to move the drive motor between the upper and lower positions thereby moving the propulsion unit between the retracted and extended positions. Where the second tube is a steering tube, the second tube is rotatable relative to the first tube, and the drive motor is rotated correspondingly with the second tube to steer or change the directional orientation of the propulsion unit. The blade assembly may have a first rotational position wherein the blade assembly presents a configuration too large to be accommodated in the second tube. In this case, the blade assembly automatically assumes a second rotational position, of a size to be accommodated in the second tube, when not being driven by the output shaft. The blade assembly may have a first configuration too large to be accommodated in the second tube, with the blade assembly being moved automatically to a second configuration, of a size to be accommodated in the second tube, in response to retraction of the propulsion unit into the second tube. The drive motor may be disposed externally of the hull and the lower end of the first tube in the lower position, and may be in an angularly offset orientation with the second tube when disposed in the lower position externally of the hull. The drive motor, in the latter case, is automatically moved to a longitudinally aligned orientation with the second tube in response to retraction of the drive motor into the second tube.

These and other objects, advantages and benefits of the present invention will become apparent upon consideration of the following detailed description of preferred embodiments thereof, particularly when taken in conjunction with the accompanying ram drawings, wherein like reference numerals and various figures are utilized to designate like or similar components.

DESCRIPTION OF THE PREFERRED EMBODIMENTS

Figure 1:
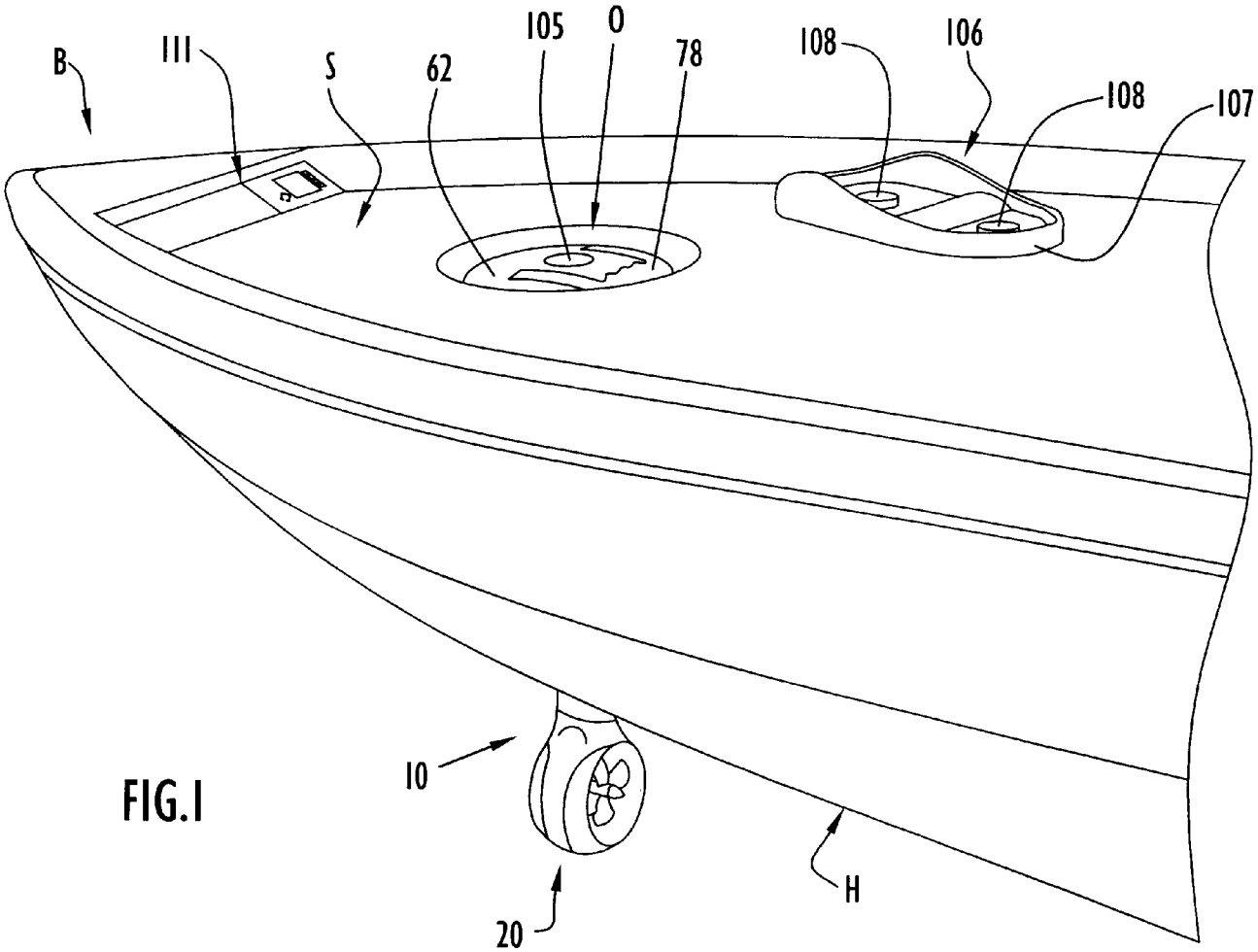
FIG. 1 is a broken, side perspective view of a boat incorporating an electric propulsion system according to the present invention and showing the propulsion unit therefor in an extended position.

FIG. 1 illustrates the electric propulsion system 10 according to the present invention installed in a conventional boat B, such as a fishing boat or a sailboat. Boat B has a hull H and a structural surface or deck S in spaced relation to hull H. Typically, the electric propulsion systems of the present invention will provide about 100 pounds of thrust for use as auxiliary or secondary power, or as a bow thruster, in boats under forty feet long, and as primary propulsion in boats under twenty feet long. Two circular openings or holes O and O', best seen in FIG. 2, about four inches in diameter are cut or otherwise formed in the surface S and hull H of the boat B in longitudinal or vertical alignment to receive a support tube of the electric propulsion system. Holes O and O' can be formed in existing and new boats in various ways with minimal modification and difficulty. FIG. 1 illustrates opening Q formed in a structural surface S which is an upper deck of boat B. However, it should be appreciated that opening O can be formed in other structural surfaces of boat B. In the case of a relatively large boat, for example, opening O can be formed in a structural surface of the forward cabin, typically the support for the V berth cushion. Of course, the diametric size of the openings O and O' may vary in accordance with the size of the support tube, which is preferably no larger than necessary to accommodate the other components of the electric propulsion system. It should also be appreciated that the electric propulsion system can be mounted on boats externally, typically off the stern transom.

Figure 2:
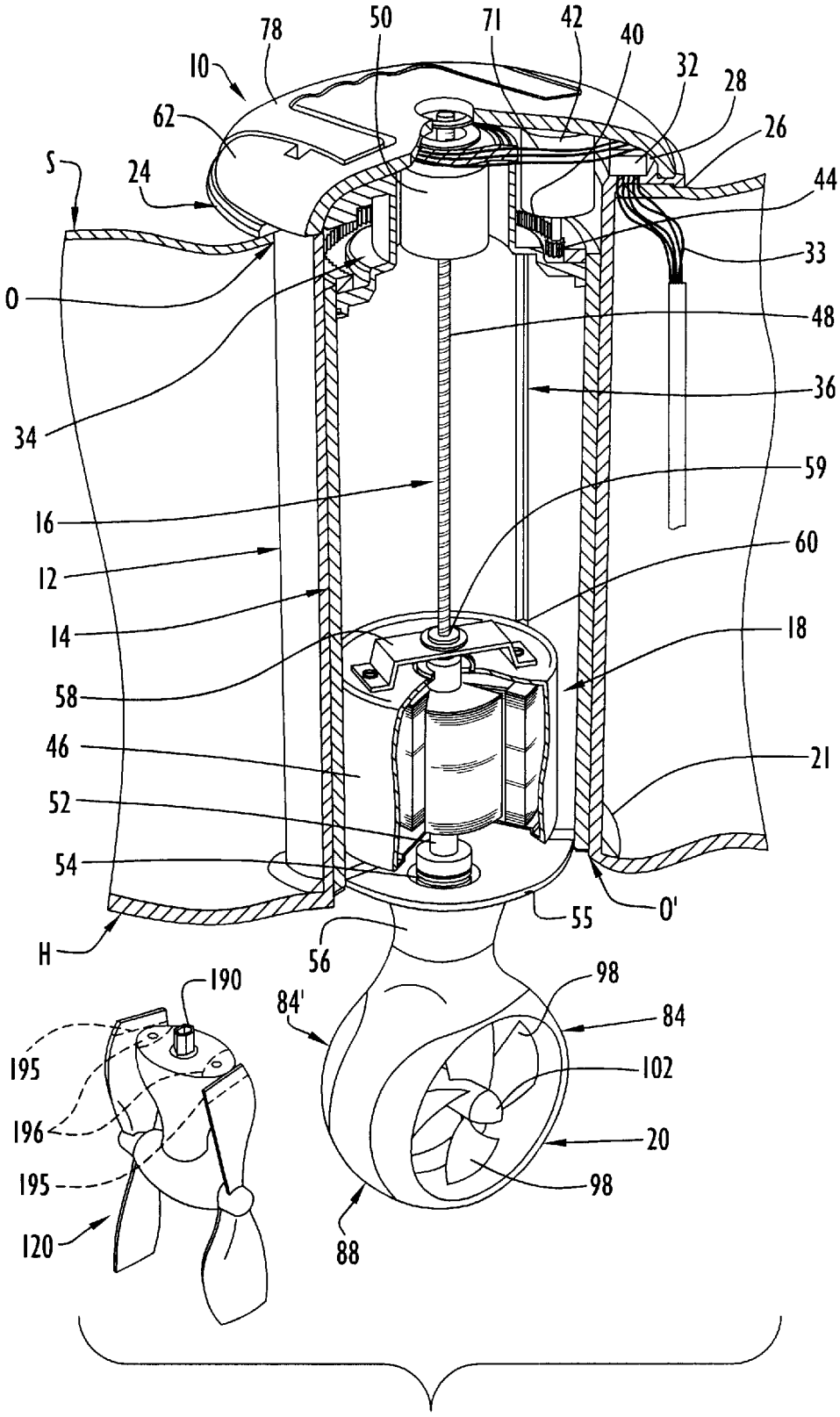
FIG. 2 is a broken perspective view, partly in cross-section, illustrating the electric Propulsion system with the propulsion unit in the extended position.
Figure 3:
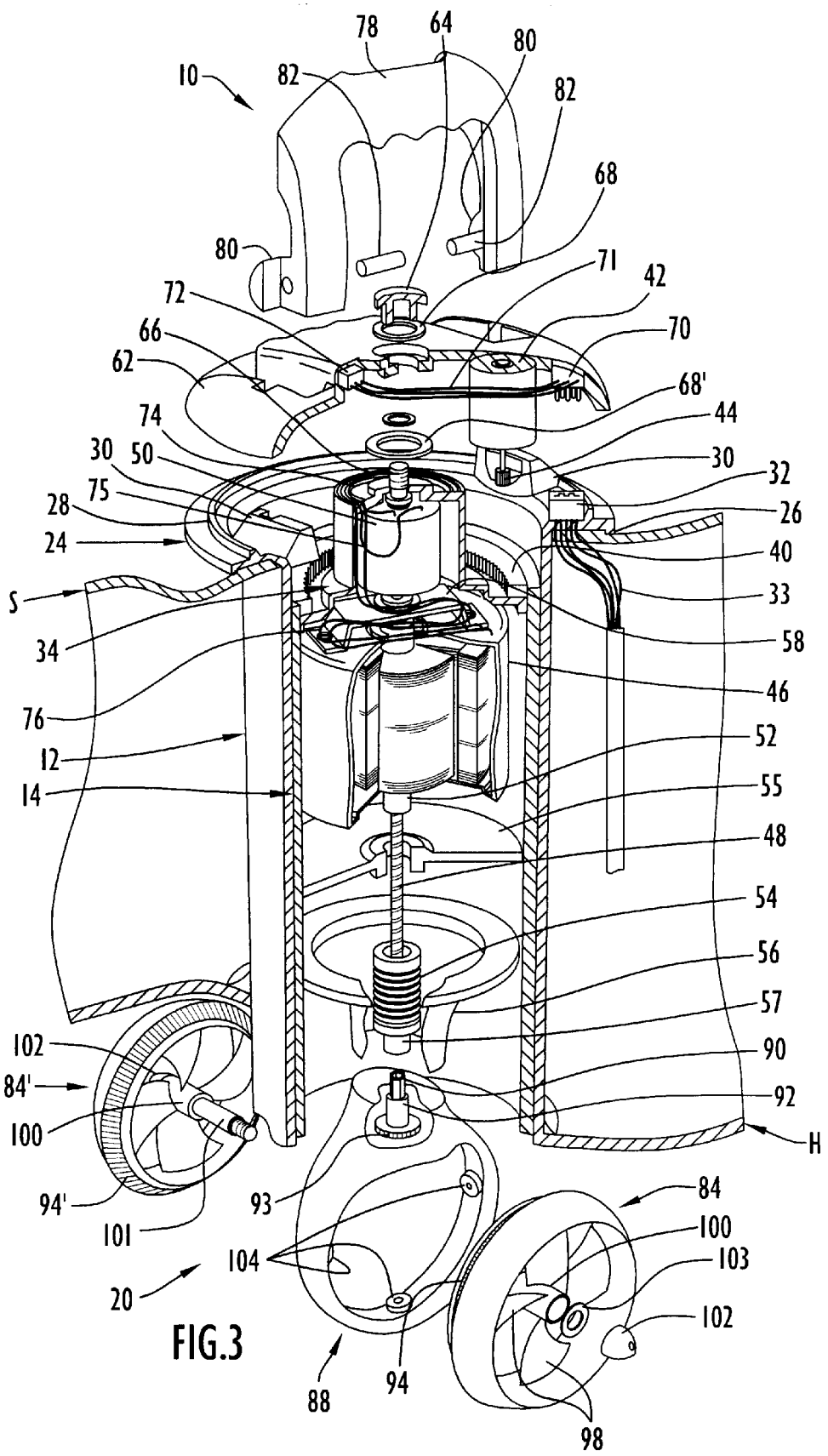
FIG. 3 is an exploded view of the electric propulsion system of FIG. 2 showing the propulsion unit in a partially retracted position.

The electric propulsion system 10 is best illustrated in FIGS. 2 and 3 and includes a support tube 12, a steering tube 14, an actuating unit 16, a drive unit 18 and a propulsion unit 20. The support tube 12 is a cylindrical tube having an external diameter about the same as the diameter of openings O and O'. The support tube 12 extends between openings O and O' and is secured to hull H near the boat's waterline and also adjacent to the boat's centerline. Preferably, the support tube is made of the same material as the hull H; and, accordingly, the support tube will typically be made of fiberglass or extruded aluminum. FIG. 2 shows the support tube 12 secured at its lower end to hull H adjacent lower opening O' via a circumferential or peripheral fillet bond 21 of a suitable adhesive such as glass fiber-filled epoxy.

The support tube 12 includes a circumferential or peripheral flange 24 at its upper end. The flange 24 is secured, such as with an adhesive/sealant, to surface S adjacent opening O. The flange 24 has a downwardly protruding circumferential or peripheral lip 26 and an upwardly protruding circumferential or peripheral shoulder 28 disposed inwardly of lip 26. The lip 26 can be trimmed to match various surface or deck shapes and helps retain adhesive/sealant used to secure the support tube to the surface S adjacent opening O. The shoulder 28 deters the entry of water into support tube 12. As shown in FIG. 3, the flange 24 is formed or provided with lug receiving receptacles 30 having recesses or cavities located to accommodate the lugs of a withdrawal handle as explained further below. The lug receiving receptacles 30 are formed integrally, unitarily with flange 24 or may be formed as separate components secured to flange 24 in various ways. As shown in FIGS. 2 and 3, a female power outlet 32 is mounted on an upper surface of flange 24 inwardly of shoulder 28. The power outlet 32 is typically selected to provide twelve, twenty four, thirty six or forty eight volts of electric power from a self-contained power source or a power source with which the power outlet is coupled, such as via wiring 33. The power outlet 32 may also be connected with, such as via wiring 33, or suitably wired to a remote control unit or panel for operating the electric propulsion system.

Where the electric propulsion system is designed to include steering capability for the propulsion unit, as is the case for electric propulsion system 10, the electric propulsion system includes steering tube 14 rotatably and concentrically disposed within support tube 12. The steering tube 14 has an external diameter that fits closely within the internal diameter of support tube 12, a lower end disposed adjacent the lower end of support tube 12, and an upper end secured to a hood 34. The steering tube 14 has a longitudinally extending groove 36 (or projection) for mating with a corresponding projection (or groove) on the drive motor of drive unit 18 to prevent rotation of the drive motor independently of or relative to the steering tube as described further below.

The hood 34 has a central cylindrical section coaxial with steering tube 14 and a stepped, annular flange section extending from a bottom end of the cylindrical section to the upper end of steering tube 14. A ring gear 40, best seen in FIG. 2, is disposed on the flange section and extends circumferentially or peripherally therealong. The ring gear 40 may be formed integrally, unitarily with the hood 34 or as a separate part fastened to the cover 34 in any suitable way. The steering tube 14 is selectively rotated relative to the support tube 12 via an electric direction or steering motor 42 mounted over the flange section and having a geared output shaft 44 in engagement with ring gear 40. The direction motor 42 is arranged within the support tube 12 so as to be disposed in the annular space defined between the support tube and the central cylindrical section of hood 34. The direction motor 42 is electrically coupled to power outlet 32 to effect rotation of output shaft 44, which causes rotation of steering tube 14 relative to support tube 12 due to the engagement of shaft 44 with ring gear 40.

The drive unit 18 is disposed in the steering tube 14 and includes an electric drive or propulsion motor 46. The actuating unit 16 includes an actuating member 48 coupled to the drive motor 46 and an actuating motor 50 for rotating actuating member 48 to effect vertical movement of the drive motor, relative to the steering tube 14, between upper and lower positions. The drive motor 46 is shown in the lower position in FIG. 2, wherein the drive motor is disposed at or towards the lower end of support tube 12 such that the propulsion unit 20, which is coupled with the drive motor, is disposed externally of the support tube and hull H. In the lower position for the drive motor 46, the drive motor is still disposed within and protected by the support tube 12. The drive motor 46 is raised vertically by the actuating member 48 for movement toward the upper position in which the propulsion unit 20 is retracted or drawn into the support tube 12 as explained further below. The drive motor is lowered by the actuating member for movement from the upper position toward the lower position.

The drive motor 46 has an output shaft 52 extending downwardly and coaxially with steering tube 14. The drive motor 46, including output shaft 52, has an axial passage therethrough allowing the actuating member 48 to pass through the drive motor as it is raised. The output shaft 52 is coupled with a flexible or bendable shaft 54 which extends through a central hole in a plate 55, to which a coupling member 56 is secured. Of course, the plate 55 can be formed integrally, unitarily with the coupling member. The coupling member 56 is disposed beneath plate 55 and has an axial passage therethrough. The flexible shaft 54 extends through the passage of coupling member 56 to a female fitting 57, shown in FIG. 3, secured to a lower end of flexible shaft 54 at the bottom of coupling member 56. The flexible shaft 54 transmits torque from the drive motor 46 to a propulsion unit coupled with the flexible shaft as described further below. The central hole in plate 55 and the axial passage through the coupling member 56, together with the flexible shaft 54 and the female fitting 57 being hollow, allows the actuating member 48 to pass therethrough, as needed, when the drive motor 46 is raised. The coupling member 56 is preferably formed of a semi-rigid material such as urethane, whereby the coupling member and shaft 54 may bend or flex upon impact with a substantial object. As explained further below, the female fitting 57 has a hex-shaped receptacle therein for releasably engaging a male hex-shaped connector of propulsion unit 20 thereby allowing the disconnection and interchangeabity of propulsion units. Of course, a releasable connection between the output shaft of the drive motor and the propulsion unit can be achieved in various ways including the use of splined and keyed couplings. A motor support or saddle 58 is secured to the top of drive motor 46 and includes a tapped hole 59, shown in FIG. 2, vertically aligned with the axial passage of motor 46. As also shown in FIG. 2, the drive motor 46 has an axially extending projection 60 (or groove) received in the groove 36 (or projection) of steering tube 14 so that the drive motor can not rotate relative to the steering tube.

The actuating member 48 for actuating unit 16 is an externally threaded rod, which passes through the tapped hole 59 and extends into the axial passage of the drive motor 46. The external thread of the rod threadedly engages the internal thread of the tapped hole 59. An upper end of the rod is coupled with the actuating motor 50, and the rod is rotated or turned thereby. The actuating motor 50, which is an electric motor powered via the power outlet 32, is disposed above the drive motor 46 within the cylindrical section of hood 34 and is attached to the hood 34. The actuating motor 50 is mechanically coupled with the actuating member 48 and is operable to turn the actuating member in first (clockwise) and second (counter clockwise) directions. Turning the actuating member 48 in a first direction causes the drive motor 46 to be moved vertically upwardly along the rod and relative to the steering tube 14 due to threaded engagement of the rod with the tapped hole 59, since the drive motor 46 can not rotate relative to the steering tube due to engagement of projection 60 with groove 36. Turning the actuating member 48 in a second, opposite direction causes the drive motor 46 to be moved vertically downwardly along the rod and relative to the steering tube 14.

A cover plate 62 of electric propulsion system 10 is connected to the hood 34 and supports the steering tube 14 from surface S. The cover plate 62 has a somewhat convex or dome-shaped configuration with a circumferential or peripheral rim that overlaps and is supported on the flange 24 of support tube 12 when the cover plate 62 is in an installed position covering or closing off opening O and the upper end of support tube 12 as shown in FIGS. 1 and 2. As shown in FIG. 1, the opening O can be formed to allow the cover plate 62 to be recessed within surface S when it is in the installed position. As best illustrated in FIG. 3, an internally threaded barrel nut 64 is secured in a central opening in cover plate 62, the barrel nut 64 being axially aligned with the center of cover 34. The barrel nut 64 is threadedly engaged and secured to an upper end of an externally threaded bolt 66 that passes through a central hole in a top wall of the cylindrical section of hood 34. A lower end of bolt 66 is secured to the actuating motor 50. Bolt 66 passes through washers 68 and 68' fastened at opposite sides of the top wall of the cylindrical section to prevent unthreading of bolt 66 when the hood 34 rotates with the steering tube 14. A male pin assembly 70 is secured to the underside of the cover plate 62 and includes a plurality of contact pins received in corresponding female receptacles of the female power outlet 32, thusly receiving the electrical power and control inputs from the power outlet 32. The pin assembly 70 is directly wired to the direction motor 42, which is secured to the underside of the cover plate. Leads 71 run from the pin assembly 70 to a brush device 72 attached to the underside of cover plate 62. The brush device 72 transfers power to the drive motor 46 and the actuating motor 50 via a series of contact rings 74 on the hood 34. The contact rings 74, in turn, are electrically connected to the drive motor 46 and the actuating motor 50 via leads 75 and 76, respectively, shown in FIG. 3.

The cover plate 62 pivotably mounts a withdrawal handle 78 having ends provided or formed with projecting lugs 80, respectively. The lugs 80 fit within corresponding slots in cover plate 62 and are accommodated within the cavities of the lug receiving receptacles 30 when the handle 78 is in an inoperative position as shown in FIGS. 1 and 2. Pins 82, shown in FIG. 3, extend through bores in the ends of handle 78, and the ends of each pin 82 are mounted to the cover plate 62. The handle 78 is rotatable about pins 82, which establish a rotation axis for the handle that is transverse to the longitudinal axis of support tube 12. The handle 78 is rotated downwardly in the inoperative position shown in FIGS. 1 and 2, the cover plate 62 being shaped with a recess 83, shown in FIG. 3, to accommodate the handle in the inoperative position so that the handle and cover plate form a smooth, continuous profile with the handle completing the external configuration of the cover plate. The handle 78 is pivoted or rotated upwardly from the inoperative position to an operative position shown in FIG. 3, wherein the handle is disposed vertically in axial line with the cover 34. In the operative position, the handle is oriented for grasping, whereby the handle may be pulled upwardly to withdraw steering tube 14 including the actuating unit 16, drive unit 18 and propulsion unit 20 from the support tube 12 via the opening O. The opening O and the upper end of support tube 12 may be closed off after the cover plate has been removed by inserting a suitable plug in or over the upper end of the support tube.

The propulsion unit 20 is illustrated in FIGS. 1–3 and is of the turbine type including a pair of blade assemblies 84 and 84' assembled to a housing 88. An alternate propulsion unit 120 of the propeller type is also illustrated in FIG. 2. The housing 88 has a generally annular configuration with an upper end that merges with the external configuration of a lower end of coupling member 56. A male coupling 90 of hex-shaped configuration extends upwardly from the upper end of housing 88 for releaseable engagement in the hex-shaped receptacle of female fitting 57, with a propulsion drive shaft 92 of the propulsion unit in driving engagement with flexible shaft 54. Since the propulsion unit 20 is thusly connected to the coupling member 56, the propulsion unit is raised and lowered with the drive motor 46 between extended and retracted positions. The male coupling 90 is hollow allowing the actuating member 48 to pass therein, if needed, when the drive motor and the propulsion unit are raised. The propulsion drive shaft 92 is rotatably mounted in housing 88 and is rotatably driven by flexible shaft 54. The drive shaft 92 is secured to a bevel drive gear 93 which rotates with the drive shaft 92. The blade assemblies 84 and 84' carry or are provided with inwardly facing, driven bevel gears 94 and 94', respectively, which are preferably molded in respective annular rims of the blade assemblies. Each of the blade assemblies includes a plurality of propulsion blades 98 radiating from a central hub 100. The blades 98 have inner ends secured to hubs 100 and outer ends secured to the annular rim. A connecting shaft 101 has externally threaded first and second ends that pass through hubs 100, respectively. The connecting shaft 101 connects the blade assemblies in proper spaced relation via internally tapered nuts 102 disposed on the first and second ends, respectively, of connecting shaft 101. When the blade assemblies are connected via shaft 101, the bevel gear 93 of propulsion drive shaft 92 is in driving engagement with the bevel gears 94 and 94'. Thrust bearings 103, only one of which is shown in FIG. 3, are disposed between nuts 102 and the blade assemblies 84 and 84', respectively, to allow the blade assemblies to freely rotate. Bearings 104 on an inner surface of housing 88 facilitate rotation of the blade assemblies. Three bearings 104 are shown for propulsion unit 20, the bearings 104 and bevel gear 93 being disposed at about 900 spaced locations along the inner surface of housing 88.

When the drive motor 46 is in the lower position, the propulsion unit 20 is in the extended position, as shown in FIGS. 1 and 2, with the blade assemblies 84 and 84' disposed externally of or exposed from the lower end of support tube 12 and, therefore, externally exposed from hull H. When the drive motor 46 is actuated, torque is transmitted via flexible shaft 54 to rotate propulsion drive shaft 92 and bevel drive gear 93 thereby rotating the blade assemblies 84 and 84' to provide propulsion. In order to steer or change the directional orientation of the propulsion unit 20, the direction motor 42 is actuated to rotate steering tube 14 due to engagement of output shaft 44 with ring gear 40. As the steering tube 14 is rotated, the propulsion unit 20 is also rotated therewith to selectively change the direction or orientation of the blade assemblies. The steering tube may be rotated a desired amount in accordance with the orientation desired for the blade assemblies. As shown in FIG. 1, the cover plate 62 is preferably provided with an indicator 105, such as a translucent window over a ring of red lights, indicating the direction the propulsion unit is facing.

When the propulsion unit 20 is not in use, it may be retracted or withdrawn into the steering tube 14 by actuating the actuating motor 50. Actuation of motor 50 causes rotation of actuating member 48 to effect movement of the drive motor 46 upwardly to the upper or raised position. Since the propulsion unit 20 is connected to the drive motor, the propulsion unit is moved from the extended position to the retracted position wherein the propulsion unit is disposed within steering tube 14 and does not protrude from hull H. In order to remove the drive unit 18 and propulsion unit the withdrawal handle 78 is moved to the operative position and is pulled upwardly to withdraw the steering tube 14 from the support tube 12. Once withdrawn, the drive motor 46 and other components can be easily removed from the steering tube 14 for servicing and/or replacement. The propulsion unit 20 can be easily disengaged from the coupling member 56 after withdrawal of the steering tube or while the steering tube is in place within the support tube.

FIG. 1 illustrates a remote, wireless foot control 106 for the electric propulsion system. The foot control 106 includes a foot pad 107 mounting one or more buttons 108, operable via foot pressure, to selectively activate the drive motor, the steering motor and/or the actuating motor to assume actuated, i.e. "on", and non-actuated, i.e., "off", states. The foot control 106 can be placed at various locations and allows the electric propulsion system to be operated from various locations on the boat. FIG. 1 also illustrates a remote, electrical control panel 111, similar to the electrical control panel 511 shown in FIG. 8. The electrical control panel may include a plurality of pressure-sensitive switches which can be depressed to implement remote electrical operation and control of the drive motor, the actuating motor and/or the direction motor. The control panel can include a suitable display with indicators for drive motor speed, drive motor/propulsion unit extension and retraction, and propulsion unit directional steering.

It should be appreciated that where steering of the propulsion unit is not desired or needed, the electric propulsion system can be provided without the direction motor and related steering components. In the latter case, the steering tube can still be provided but does not rotate, and serves as a motor tube within which the drive motor and the propulsion unit are raised and lowered, with the motor tube being withdrawable from the support tube to remove the drive motor and propulsion unit therefrom. Even where a steering tube is provided in the electric propulsion system, a motor tube which houses the drive unit may be disposed concentrically within the steering tube. In this case, the motor tube can be engaged with the steering tube so as to rotate therewith in order to effect directional steering of the propulsion unit. The drive unit and propulsion unit may be raised and lowered relative to and within the motor tube in a manner similar to that described above for raising and lowering the drive unit and propulsion unit within the steering tube. Alternatively, the motor tube may be moved vertically relative to and within the steering tube, with the drive motor and propulsion unit secured to the motor tube for movement therewith so as to effect raising and lowering of the drive motor and propulsion unit within the steering tube. Where a steering tube and motor tube are provided, the withdrawal handle can be coupled with one or more components of the electric propulsion system to permit withdrawal of the motor tube without the steering tube, which may remain within the support tube, or to permit withdrawal of the steering tube and the motor tube simultaneously.

Lifting or raising of the drive motor can also be accomplished using a lift rod having lugs at its upper and lower ends corresponding to the locations for the drive motor in the upper and lower positions, respectively. The lift rod may then operate as a quarter-turn fastener if a corresponding receptacle for the lugs is fastened to the drive motor, such as being fastened to the saddle thereof. In the latter case, the lift rod and lugs would hold the drive motor in the upper and lower positions. An actuating handle or knob for actuating or operating the lift rod, i.e. the actuating member, can be incorporated in the cover plate.

Figure 4:
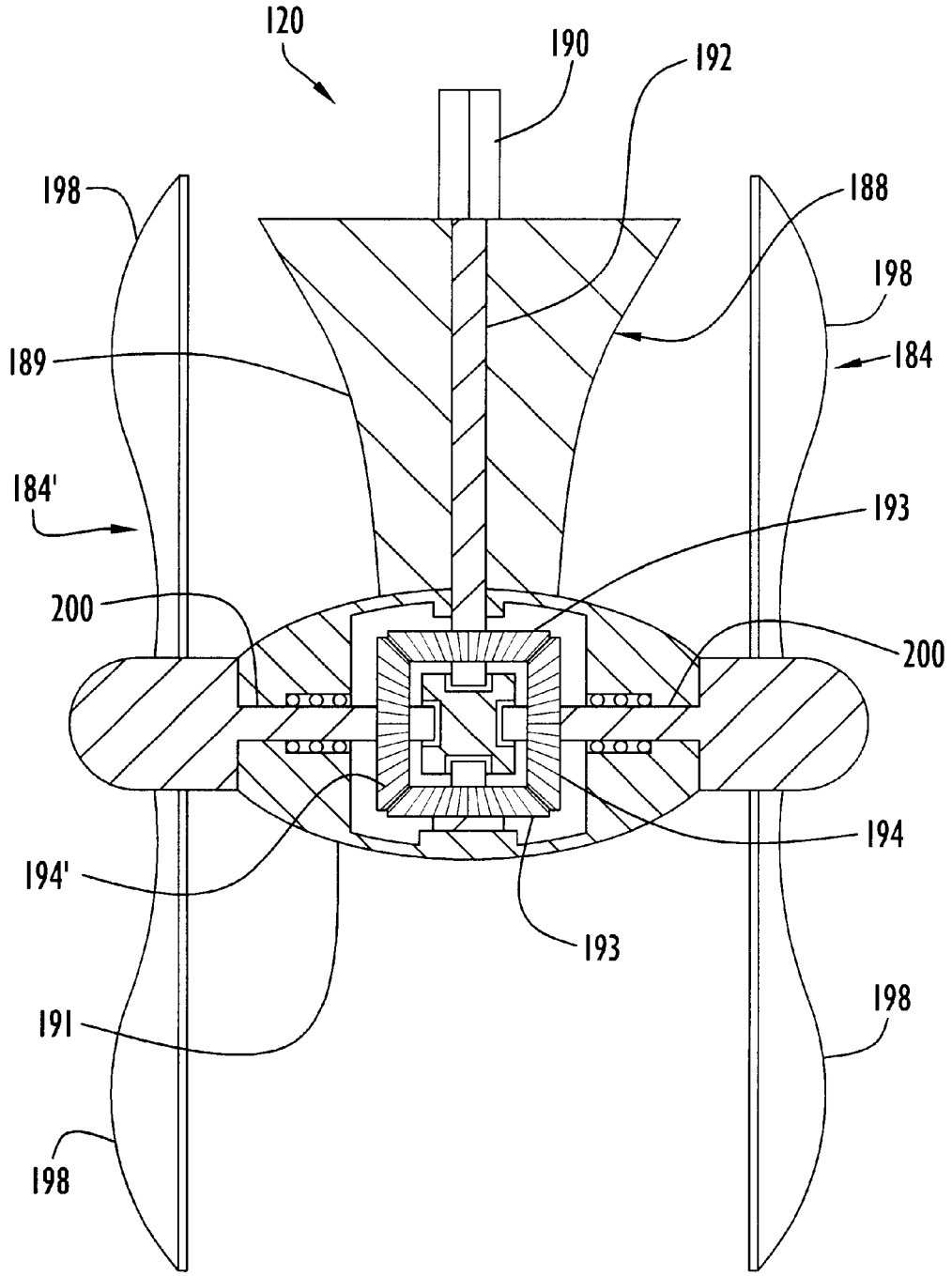
FIG. 4 is a side view, partly in cross-section, illustrating an alternative propulsion unit for the electric propulsion systems according to the present invention.

FIGS. 2 and 4 illustrate alternative propulsion unit 120 comprising housing 188 and blade assemblies 184 and 184'. Housing 188 has an upper portion 189, from which male coupling 190 extends upwardly, and a lower portion 191 mounting the AlS blade assemblies 184 and 184'. The upper portion 189 has an external configuration that merges with the external configuration of coupling member 56 when male coupling 190 is engaged with female fitting 57 as described above. The lower portion 191 extends in a direction transverse to upper portion 189 and encloses one or more bevel drive gears 193 and bevel driven gears 194 and 194'. Drive gears 193 are rotatably driven by propulsion drive shaft 192 when the drive shaft 192 is rotated. Driven gears 194 and 194' are carried by or coupled with blade assemblies 184 and 184', respectively, and are rotated in opposite directions from one another in response to rotation of drive gears 193. The front and rear blade assemblies 184 and 186 each include a pair of blades 198 extending from a central hub 200 at 180° spaced locations. The distance between the outer ends of blades 198 for each blade assembly is greater than the internal diameter of steering tube 14; and, accordingly, the blades 198 must be oriented vertically for retraction into steering tube 14. Accordingly, when the blade assembly is in the rotational position shown in FIGS. 2 and 4, the blade assembly presents a configuration capable of being accommodated within the steering tube. If, however, the blade assembly is in a rotational position rotated 90° form the rotational position shown in FIGS. 2 and 4, the blade assembly presents a configuration an orientation too large to be accommodated in the steering tube. As shown in dotted lines in FIG. 2, one blade 198 of each pair has magnetic material or an insert 195 at its outer end, and the upper portion 189 of housing 188 has magnetically attractive material or an insert 196 attractive to magnetic material or insert 195. In this way, the blade assemblies 184 and 184' are automatically encouraged to orient vertically, as shown in FIGS. 2 and 4, when not being rotated by the drive unit of the electric propulsion system. The blade assemblies 184 and 184' are thusly ensured of being in the proper orientation for retraction into the steering tube. Alternatively, each blade assembly 184 and 184' can be collapsible, with the blades 198 of each pair being capable of independent rotation relative to each other as shown by arrows in FIG. 2, allowing the blades of each pair to automatically scissor or collapse for retraction into the steering tube with all of the blades 198 oriented in a downward position. By collapsing in this manner, the blades are self-cleaning in that weeds and debris should be freed therefrom as the blades collapse. Springs or other means can be used to automatically bias or move the blades to the uncollapsed orientation when the propulsion unit 120 is in the extended position.

Figure 5:
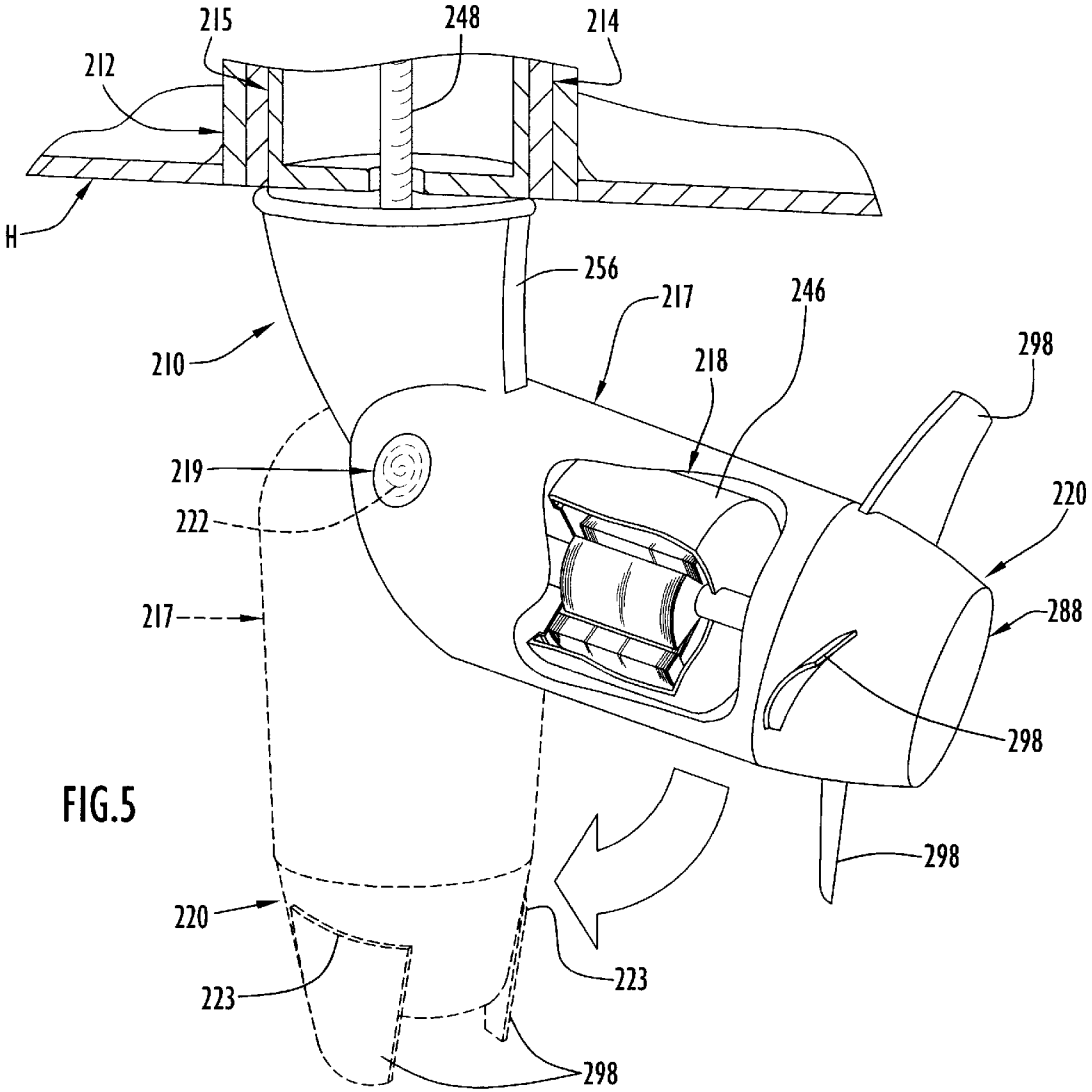
FIG. 5 is a broken perspective view, partly in cross-section, illustrating an alternative electric propulsion system according to the present invention with the propulsion unit therefor in the extended position.

An alternative electric propulsion system is illustrated at 210 in FIG. 5. The electric propulsion system 210 is similar to the electric propulsion system 10 but includes a swivel drive unit 218. The electric propulsion system 210 includes support tube 212 and steering tube 214 rotatable within support tube 212. A motor tube 215 is concentrically disposed in steering tube 214 and has an external, longitudinally extending projection (or groove) (not shown) engaged in an internal, longitudinally extending groove (or projection) (not shown) of steering tube 214 to prevent the motor tube from rotating relative to the steering tube as described above for projection 60 and groove 36. The steering tube 214 is rotated by a direction motor as described above or manually, which results in corresponding rotation of the motor tube 215. A coupling member 256 is movable longitudinally, vertically within the motor tube 215, as effected manually or by an actuating motor (not shown) turning actuating member 248. Rotational movement of the motor tube 215 in response to rotation of the steering tube 214 results in corresponding rotational movement of coupling member 256. The coupling member 256 mounts the drive unit 218 and propulsion unit 220 of the electric propulsion system 210. The drive unit 218 includes drive motor 246 contained in an enclosure or housing 217 pivotally mounted to the coupling member 256 by a joint 219. Joint 219 may include a torsion spring 222, shown in dotted lines, for biasing the enclosure 217 to a deployed position in which the enclosure 217 extends from the coupling member 256 at an angle, preferably about 90°, and is therefore angularly offset from a longitudinal axis of the motor tube. Joint 219 may comprise a hinge mechanism rotating around a swivel pin. Alternatively, the joint may be formed of semi-flexible material such as stainless steel spring material or a polymer such as urethane.

The propulsion unit 220 includes a blade assembly comprising housing 288 of truncated conical configuration rotatably mounted on the lower end of enclosure 217 and a plurality of blades 298 extending radially from housing 288. The housing 288 may be made of buoyant material, thereby assisting movement of the enclosure 217 to the deployed position. The blades 298, which are preferably formed of stainless steel or the like, are mounted to the housing 288 via hinges 223. The hinges 223 allow the blades to pivot from the radially extended position or configuration and fold flat against the housing 288 to assume a collapsed position or configuration for retraction into motor tube 215. The housing 288 is rotated by the drive motor 246 when the enclosure 217 is in the deployed position with the propulsion unit 220 in the extended position to provide propulsion for a boat B. Once the housing 288 begins rotating, centrifugal force and pressure on the blades 298 exerted by water being forced rearward as the blades are rotated ensures that the blades are maintained in the radially extended position.

It should be appreciated that the electric propulsion system 210 can be provided with or without motor tube 215. Where the motor tube 215 is provided, the coupling member 256, the drive unit 218 and the propulsion unit 220 can all be retracted within the motor tube 215. The motor tube 215 can be withdrawn from the steering tube 214 leaving the steering tube and the support tube 212 in place, or the motor tube 215, and the various components within it, can be withdrawn simultaneously with the steering tube when the steering tube 214 is withdrawn from the support tube. As the coupling member 256 is withdrawn into the motor tube, engagement of the enclosure 217 with the lower end of the motor tube will cause the enclosure 217 to pivot or rotate downwardly from the deployed position to an undeployed position shown in dotted lines and by the arrow in FIG. 5. In the undeployed position the enclosure 217 is in line with the longitudinal axis of the motor tube and presents a configuration facilitating retraction of the enclosure into the motor tube. As the housing 288 is retracted into the motor tube, contact of the blades 298 with the lower end of the motor tube causes the blades 298 to pivot downwardly from the radially extended position to the collapsed position so that the propulsion unit 220 may be withdrawn into the motor tube in the retracted position. Thereafter, when the drive unit and the propulsion unit are moved to the extended position, the enclosure 217 automatically moves to the deployed position and the blades 298 automatically assume the radially extended position.

Figure 6:
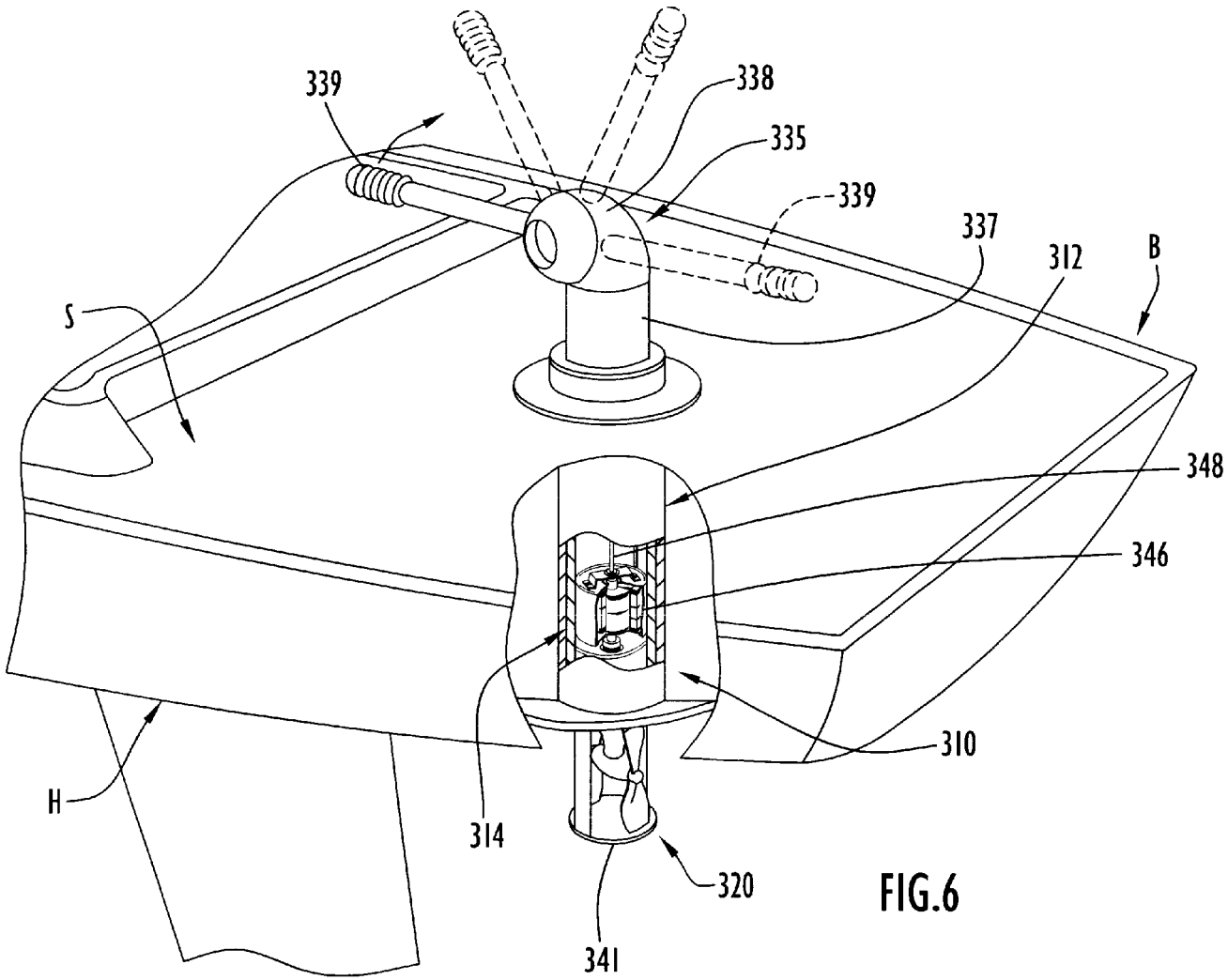
FIG. 6 is a perspective view, partly in cross-section, illustrating an additional alternative electric propulsion system according to the present invention with the propulsion unit therefor in the extended position.

FIG. 6 illustrates an alternative electric propulsion system 310 incorporating a manual actuating mechanism 335 operable to effect manual steering of the propulsion unit and/or manual movement of the propulsion unit between the extended and retracted positions. The electric propulsion system 310 is similar to electric propulsion system 10 and includes support tube 312 and steering tube 314 rotatable within support tube 312. The upper end of the steering tube is attached to a rotatable handle support 337 that protrudes above surface S in axial alignment with the steering tube. A cap 338 is fixed to the handle support 337, and an end of an actuating handle 339 is pivotally mounted to one side of the cap. The actuating handle 339 is rotatable about a vertical rotation axis, as shown by an arrow in FIG. 6, to selectively rotate handle support 337 and, therefore, steering tube 314 for directional steering. Vertical raising and lowering of the propulsion unit 320 is accomplished manually via the actuating handle 339 and an actuating member 348 connected between the handle 339 and the drive motor 346, which is disposed within the steering tube 314 and rotates therewith. Actuating member 348 comprises an actuating cable which is selectively wound and unwound about a drum (not shown) in response to pivotal movement of the actuating handle 339, relative to the cap 338, about a horizontal rotation axis transverse or perpendicular to the vertical rotation axis. When the actuating handle 339 is in a first pivoted position, illustrated in solid lines in FIG. 6, the cable is unwound and the drive motor 346 is in the lower position with the propulsion unit 320 in the extended position. When the actuating handle 339 is pivoted 180° to a second pivoted position, illustrated in dotted lines, the drive cable is wound and the motor 346 is moved to the upper position with propulsion unit 320 being moved to the retracted position within the steering tube 314. Various locking mechanisms may be provided, if necessary, on or in the manual actuating mechanism to lock the actuating handle in desired rotational and/or pivotal positions. The propulsion unit 320 is similar to propulsion unit 120 but includes a bottom plate 341 to reduce the possibility of water spray or waves being forced up the steering tube when the propulsion unit is in the retracted position with the boat B underway. The handle support 337 can be manually lifted or pulled upwardly to remove the steering tube from the support tube for withdrawal of the drive motor and propulsion unit.

Figure 7:
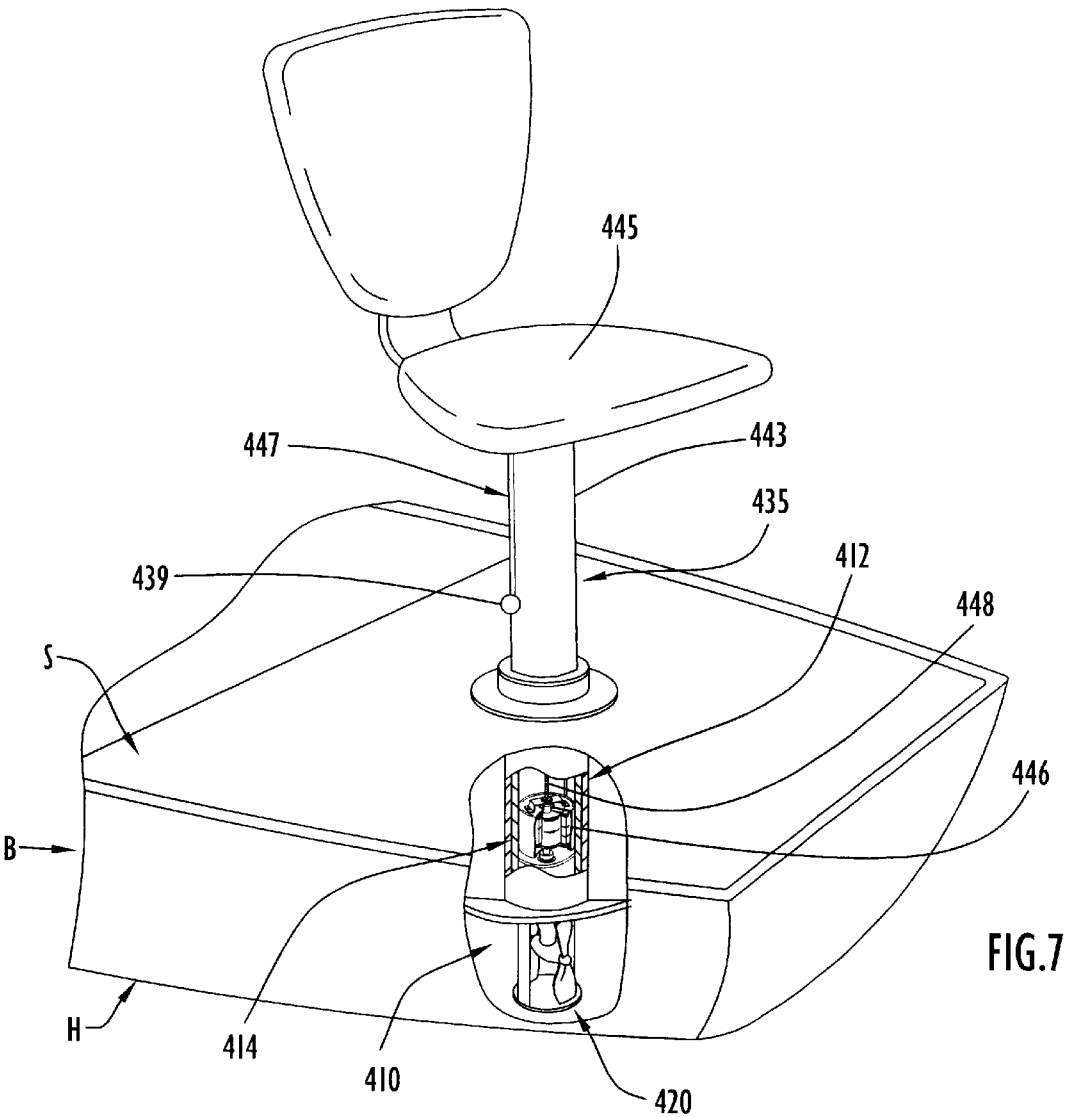
FIG. 7 is a broken perspective view, partly in cross-section, illustrating a further alternative electric propulsion system according to the present invention with the propulsion unit thereof in the retracted position.

Another alternative electric propulsion system is illustrated at 410 in FIG. 7. The electric propulsion system 410 is similar to electric propulsion system 310 but includes a modified manual actuating mechanism 435 operable to effect manual steering of the propulsion unit 420 and/or manual extension and retraction of the propulsion unit 420. The steering tube 414 for electric propulsion system 410 is rotatably disposed in support tube 412 and is connected to a tubular seat support or pedestal 443 extending upwardly from surface S. The seat support 443 is coaxial with the steering tube 414 and supports a seat 445, such as a fishing seat. When the seat 445 is rotated about a central longitudinal axis of the steering tube 414, the seat support 443 is also rotated, thereby rotating the steering tube to effect directional steering of propulsion unit 420. The seat support 443 has a longitudinally extending slot 447 therein, and an actuating handle or knob 439 projects through the slot 447 and a similar slot in the steering tube 414 for sliding movement. The actuating handle 439 is connected to the actuating member 448, which is an actuating rod coupled or connected with drive motor 446. The actuating handle 439 is moved in the longitudinal slot 447 to selectively raise and lower the actuating member, and with it the drive motor. In FIG. 7, the actuating handle 439 is disposed at the bottom of the slot 447, with the drive motor 446 in the lower position and the propulsion unit in the extended position. The actuating handle 439 is manually moved upwardly within the slot 447 to move the drive motor 446 to the upper position so that the propulsion unit 420 is moved to the retracted position. The actuating handle 439 can be moved from the longitudinal slot 447 into an L-shaped locking recess in the seat support 443 to lock the actuating handle in a position corresponding to the retracted position for the propulsion unit. Alternatively, the knob can be unscrewed or pulled out to allow the drive motor to be raised. The knob could also be used to control the speed of the drive motor and directional steering of the propulsion unit. It should be appreciated that the seat 445 can be designed to rotate independently of the steering tube 414, for example by the passenger taking some weight off the seat. When less than about fifty pounds is applied to the seat 445, the seat may be automatically disengaged or disconnected from the steering tube 414 allowing the seat to turn independently thereof. When about fifty pounds or more is applied to the seat, the seat may be automatically engaged or connected to the steering tube to effect rotation of the steering tube when the seat is correspondingly rotated. The seat 445 can be lifted off the seat support 443 allowing the seat support to be lifted or pulled upwardly to withdraw the steering tube from the support tube.

Figure 8:
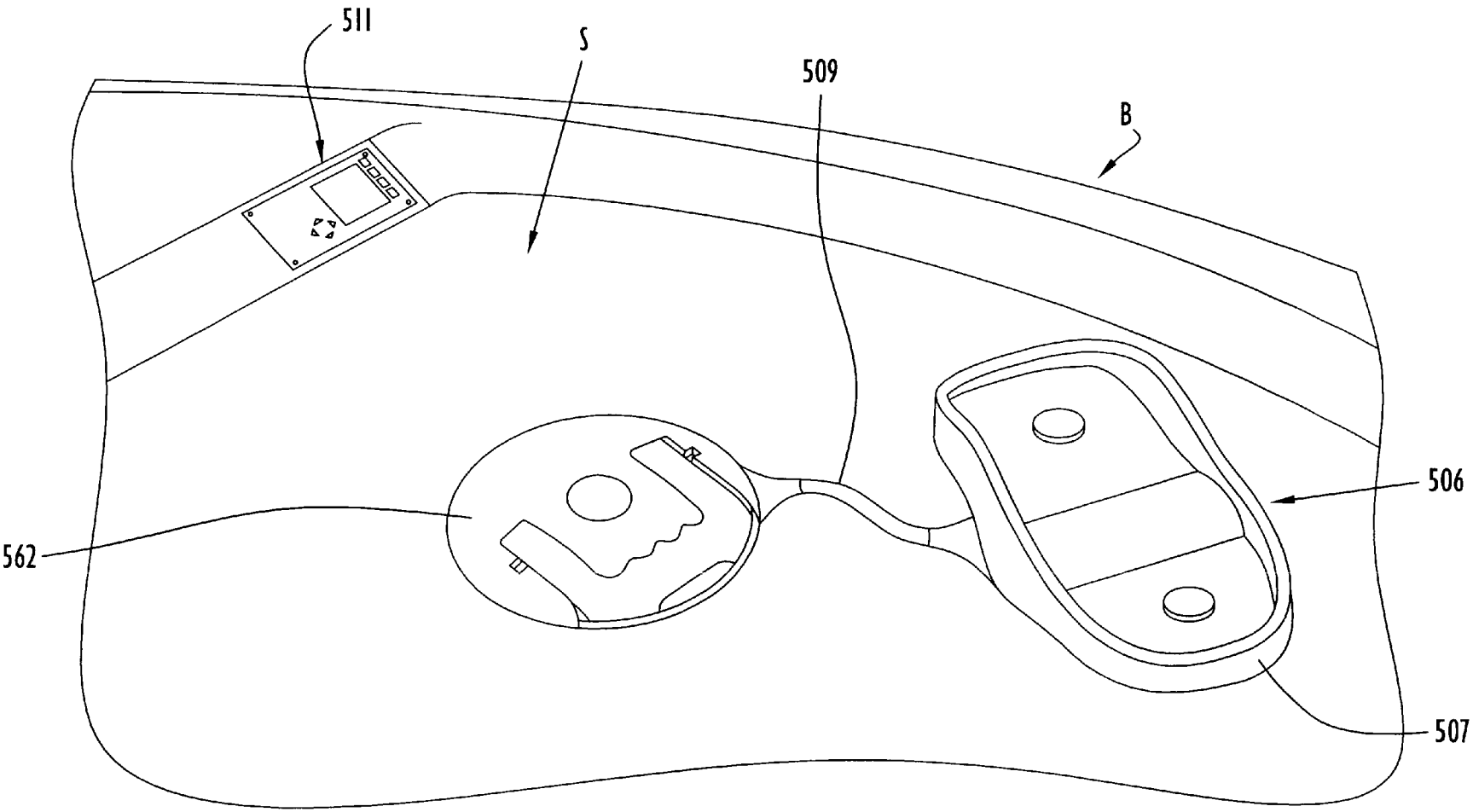
FIG. 8 is a top perspective view of a boat showing a foot control for the electric propulsion systems of the present invention.

FIG. 8 illustrates an alternative manual actuating mechanism in the form of a foot control 506 for operating the electric propulsion systems of the present invention. The foot control 506 is designed to manually raise and lower the drive motor and propulsion unit of the electric propulsion system in a manner similar to manual actuating mechanism 335. The foot control 506 includes a footpad 507 and a mechanical connecter 509 mechanically connecting the footpad 507 to a drum (not shown) mounted beneath the cover plate 562. The footpad 507 is movable in an arcuate path about the cover plate 562, i.e. about the central longitudinal axis of the support tube, to selectively wind and unwind a cable connected to the drive motor. In this manner, the drive motor and the propulsion unit coupled thereto can be raised and lowered for movement of the propulsion unit between extended and retracted positions. FIG. 8 also illustrates an electric control panel 511, similar to electric control panel 111.

With the electric propulsion systems of the present invention, cleaning or servicing is easily accomplished by withdrawing the drive motor and propulsion unit as a single, unitary assembly utilizing a simple lifting motion. The propulsion units can be cleaned or serviced without withdrawal of the drive motors by disconnecting the propulsion units from the drive units at the lower end of the support tube. Also, the propulsion units may be self-cleaning via a collapsing or scissoring action of the blades. Since the drive motor is normally above the waterline when not in use, reliability and life of the drive motor should be greatly enhanced. An airlock system can be incorporated in the electric propulsion systems where the drive motor may be disposed below the waterline in the lower position. The airlock system may allow air to be pulled into the steering tube or motor tube when the drive motor is lowered and may seal off the steering tube or motor tube when the drive motor stops moving or is raised. The propulsion units can deflect to avoid breakage due to impacts with objects. The propulsion shafts and/or hubs can be hollow so as to receive a rigid, non-rotating rod which prevents excessive vibration. The electric propulsion systems can include an interlock system preventing retraction of the propulsion unit while the drive motor is running. The support tube can be provided with supporting brackets at selected locations along its length. The electric propulsion systems can be used in various types of boats including fishing boats, sailboats, canoes and kayaks.

Inasmuch as the present invention is subject to many variations, modifications and changes in detail, it is intended that all subject mater discussed above or shown in the accompanying drawings be interpreted as illustrative only and not be taken in a limiting sense.

What is claimed is:

1. An electric propulsion system for use in a boat having a hull and a surface in spaced relation to the hull, said electric propulsion system comprising a support tube extending between an opening in the surface and an opening in the hull longitudinally aligned with the opening in the surface, said support tube being fixedly secured to the hull and having an upper end adjacent the opening in the surface and a lower end adjacent the opening in the hull;

a steering tube concentrically disposed in said support tube, said steering tube being movable within said support tube longitudinally and rotationally, said steering tube being movable upwardly in the longitudinal direction for removal from said upper end of said support tube;

an electric drive motor within said steering tube and being rotatable therewith, said drive motor being movable longitudinally within said steering tube between upper and lower positions, said drive motor having a rotatable output shaft;

an actuating member in said steering tube for moving said drive motor between said upper and lower positions; and a propulsion unit having a rotatable drive shaft rotationally driven by said output shaft of said drive motor and having a plurality of blades rotated by said drive shaft to provide propulsion for the boat, said propulsion unit being coupled with said drive motor to move rotationally and longitudinally therewith, said propulsion unit being in a retracted position when said drive motor is in said upper position and being in an extended position when said drive motor is in said lower position, said propulsion unit being disposed within said steering tube in said retracted position and being exposed from the hull and from said lower end of said steering tube in said extended position.

2. The electric propulsion system as recited in claim 1 and further including a withdrawal handle coupled with said steering tube for pulling said steering tube upwardly for removal from said upper end of said support tube.

3. The electric propulsion system as recited in claim 2 and further including a cover plate disposed over said upper end of said support tube and wherein said withdrawal handle is pivotally mounted on said cover plate.

4. The electric propulsion system as recited in claim 3 wherein said drive motor is prevented from rotating relative to said steering tube, said actuating member includes an externally threaded actuating rod and further including an internally threaded member secured to said drive motor in threaded engagement with said actuating rod, said actuating rod being rotatable to effect longitudinal movement of said drive motor along said actuating rod and relative to said tube between said upper and lower positions, and further including an electric actuating motor within said steering tube for rotating said actuating rod.

5. The electric propulsion system as recited in claim 1 wherein said actuating member is coupled to said drive motor and further including means for operating said actuating member to move said drive motor between said upper and lower positions.

6. The electric propulsion system as recited in claim 5 wherein said means for operating includes an actuating motor.

7. The electric propulsion system as recited in claim 1 and further including an electric direction motor within said support tube for rotating said steering tube.

8. The electric propulsion system as recited in claim 1 and further including an actuating mechanism mounted on the surface for manually rotating the steering tube.

9. The electric propulsion system as recited in claim 8 wherein said actuating mechanism is a handle.

10. The electric propulsion system as recited in claim 8 wherein said actuating mechanism is a footpad.

11. The electric propulsion system as recited in claim 1 and further including a flexible shaft coupling said output shaft with said drive shaft, said flexible shaft extending through said lower end of said support tube.

12. An electric propulsion system for use in a boat having a hull and a surface in spaced relation to the hull, said electric propulsion system comprising a first tube extending between an opening in the surface and an opening in the hull longitudinally aligned with the opening in the surface, said first tube being fixedly secured to the hull and having an upper end adjacent the opening in the surface and a lower end adjacent the opening in the hull;

a second tube concentrically disposed in said first tube, said second tube being longitudinally moveable within said first tube for removal from said upper end of said first tube;

an electric drive motor within said second tube, said drive motor being movable longitudinally in said second tube between upper and lower positions, said drive motor having a rotatable output shaft;

an actuating mechanism in said second tube for moving said drive motor between said upper and lower positions; and a propulsion unit releasably coupled with said output shaft and having a blade assembly rotatably driven by said output shaft, said propulsion unit being longitudinally moveable with said drive motor between retracted and extended positions, said propulsion unit being disposed in said retracted position when said drive motor is in said upper position and being disposed in said extended position when said drive motor is in said lower position, said blade assembly being retracted within said second tube in said retracted position, said blade assembly being disposed externally of the hull and said second tube in said extended position, said blade assembly having a first rotational position wherein said blade assembly presents a first configuration too large to be accommodated in said second tube, said blade assembly having a second rotational position wherein said blade assembly presents a second configuration of a size to be accommodated in said second tube, said blade assembly automatically assuming said assume said second rotational position when not being driven by said output shaft.

13. The electric propulsion system as recited in claim 12 wherein said blade assembly includes magnetic material causing said blade assembly to automatically second rotational position when not being driven by said output shaft.

14. An electric propulsion system for use in a boat having a hull and a surface in spaced relation to the hull, said electric propulsion system comprising a first tube extending between an opening in the surface and an opening in the hull longitudinally aligned with the opening in the surface, said first tube being fixedly secured to the hull and having an upper end adjacent the opening in the surface and a lower end adjacent the opening in the hull;

a second tube concentrically disposed in said first tube, said second tube being longitudinally movable within said first tube for removal from said upper end of said first tube;

an electric drive motor within said second tube, said drive motor being longitudinally movable in said second tube between upper and lower positions, said drive motor having a rotatable output shaft;

an actuating mechanism in said second tube for moving said drive motor between upper and said lower positions; and a propulsion unit releasably coupled with said output shaft and having a blade assembly rotatably driven by said output shaft, said propulsion unit being longitudinally movable with said drive motor between retracted and extended positions, said propulsion unit being disposed in said retracted position when said drive motor is in said upper position and being disposed in said extended position when said drive motor is in said lower position, said blade assembly being retracted within said second tube in said retracted position, said blade assembly being disposed externally of the hull and said second tube in said extended position, said blade assembly having a first configuration too large to be accommodated in said second tube, said blade assembly being automatically movable from said first configuration to a second configuration, of a size to be accommodated in said second tube, in response to retraction of said propulsion unit into said second tube, said blade assembly automatically returning to said first configuration in response to extension of said propulsion unit from said second tube.

15. The electric propulsion system as recited in claim 14 wherein said blade assembly includes a plurality of blades extending outwardly from a hub in said first configuration, said blades being independently movable relative to one another and said hub to assume a collapsed configuration in said second configuration.

16. The electric propulsion system as recited in claim 14 wherein said blade assembly includes a plurality of blades extending outwardly form a hub in said first configuration, said blades being hingedly mounted to said hub to lie along side said hub in said second configuration.

17. An electric propulsion system for use in a boat having a hull and a surface in spaced relation to the hull, said electric propulsion system comprising:

a first tube extending between an opening in the surface and an opening in the hull longitudinally aligned with the opening in the surface, said first tube being fixedly secured to the hull and having an upper end adjacent the opening in the surface and a lower end adjacent the opening in the hull;

a second tube concentrically disposed in said first tube, said second tube being longitudinally movable within said first tube for removal from said upper end of said first tube;

an electric drive motor having a rotatable output shaft, said drive motor being coupled with said second tube for removal therewith from said upper end of said first tube, said drive motor being longitudinally movable relative to said second tube between upper and lower positions, said drive motor being retracted within said second tube in said upper position and being disposed externally of the hull and said second tube in said lower position, said drive motor being in a longitudinally aligned orientation with said second tube in said upper position and being angularly offset from said second tube in said lower position, said drive motor automatically assuming an angularly offset orientation in said lower position and being automatically moved to said longitudinally aligned orientation in response to retraction of said drive motor into said second tube when said drive motor is moved from said lower position to said upper position;

an actuating member in said second tube for moving said drive motor between said upper and lower positions; and a propulsion unit releasably coupled with said output shaft and having a blade assembly rotatably driven by said output shaft, said propulsion unit being longitudinally movable with said drive motor between retracted and extended positions, said propulsion unit being disposed in said retracted position when said drive motor is in said upper position and being disposed in said extended position when said drive motor is in said lower position, said propulsion unit being retracted within said second tube in said retracted position and being disposed externally of the hull and said second tube in said extended position.

18. The electric propulsion system as recited in claim 17 wherein said drive motor is biased to said angularly offset orientation.

19. The electric propulsion system as recited in claim 18 and further including a coupling member between said actuating member and said drive motor and an enclosure containing said drive motor, said enclosure being pivotally mounted to said coupling member.

* * * * *